US007755573B2

(12) United States Patent
Seo et al.

(10) Patent No.: US 7,755,573 B2
(45) Date of Patent: Jul. 13, 2010

(54) ELECTRIC CHARGING/DISCHARGING APPARATUS, PLASMA DISPLAY PANEL, AND ELECTRIC CHARGING/DISCHARGING METHOD

(75) Inventors: Yoshiho Seo, Kanagawa (JP); Kazushige Takagi, Kanagawa (JP); Tadayoshi Kosaka, Kanagawa (JP); Hajime Inoue, Kanagawa (JP); Koichi Sakita, Kanagawa (JP)

(73) Assignee: Hitachi Plasma Patent Licensing Co., Ltd, Tokyo (JP)

( * ) Notice: Subject to any disclaimer, the term of this patent is extended or adjusted under 35 U.S.C. 154(b) by 520 days.

(21) Appl. No.: 11/815,020

(22) PCT Filed: Jan. 31, 2005

(86) PCT No.: PCT/JP2005/001349

§ 371 (c)(1),
(2), (4) Date: Jul. 30, 2007

(87) PCT Pub. No.: WO2006/082621

PCT Pub. Date: Aug. 10, 2006

(65) Prior Publication Data

US 2009/0009430 A1 Jan. 8, 2009

(51) Int. Cl.
*G09G 3/28* (2006.01)

(52) U.S. Cl. ..... 345/60; 345/62; 345/66

(58) Field of Classification Search ..... 345/60–69; 315/169.1–169.4

See application file for complete search history.

(56) References Cited

U.S. PATENT DOCUMENTS 6,833,823 B2 * 12/2004 Sakita ..... 345/60
7,333,075 B2 * 2/2008 Chung et al. ..... 345/60
7,420,528 B2 * 9/2008 Lee ..... 345/60

FOREIGN PATENT DOCUMENTS

| | | |
|---|---|---|
| JP | 10-105114 | 4/1998 |
| JP | 2001-056666 | 2/2001 |
| JP | 2001-272945 | 10/2001 |
| WO | WO 00/00956 | 1/2000 |

* cited by examiner

*Primary Examiner*—Vijay Shankar
(74) *Attorney, Agent, or Firm*—Antonelli, Terry, Stout & Kraus, LLP.

(57) ABSTRACT

A charging/discharging apparatus (602) for charging a capacitance to be charged/discharged (Cp) includes: a recovery capacitor (Cr1) for recovering electric energy which has one terminal connected to a first power supply (GND) through first switch means (SW11) and another terminal connected to a second power supply (Vs+Vo) through second switch means (SW12); first path forming means (D11) which has one terminal connected to a connection point between the second power supply and the other terminal of the recovery capacitor and another terminal connected to the capacitance to be charged/discharged, and charges the capacitance to be charged/discharged through a resonant inductor (L1) when the first switch means is turned on; second path forming means (D12) which has one terminal connected to a connection point between the first power supply and the one terminal of the recovery capacitor and another terminal connected to the capacitance to be charged/discharged, and discharges the capacitance to be charged/discharged through the resonant inductor (L1) when the second switch means is turned on to recover electric energy to the recovery capacitor.

10 Claims, 8 Drawing Sheets

ELECTRIC CHARGING/DISCHARGING APPARATUS, PLASMA DISPLAY PANEL, AND ELECTRIC CHARGING/DISCHARGING METHOD

TECHNICAL FIELD

The present invention relates to recovery of electric energy accumulated in a capacitance and, more particularly, to an apparatus which recovers electric charges accumulated by applying a pulsed voltage to a capacitor formed on a cell constituting a screen of a plasma panel display (PDP), a plasma display panel, and an electric charging/discharging method.

BACKGROUND ART

There is known a technique for recovering electric energy of an applied pulse such that electric charges accumulated by applying a sustain pulse voltage to a capacitor formed in a plurality of cells constituting a screen of a PDP are recovered by using a capacitor for recovering electric energy. The recovered electric charges are used to apply a next sustain pulse voltage. In this technique, electric charges accumulated in a cell at a rising edge of one applied pulse are recovered at a trailing edge of the applied pulse.

Japanese Patent Publication Laid-Open No. 10-105114 (A) disclosed on Apr. 24, 1998 describes a power recovery apparatus for a PDP which enables charging and discharging power also in application of a negative voltage. This power recovery apparatus includes a positive voltage charging/discharging unit which charges a positive voltage and discharges the charged positive voltage to a discharging electrode in a next electrode discharging state, a negative voltage discharging unit which charges a negative voltage and discharges the charged negative voltage to the discharging electrode in a next electrode discharging state, and a controller which controls inputting of an external voltage and electric charging/discharging by the positive/negative voltage charging/discharging unit.

Patent Document 1: Japanese Patent Publication Laid-Open No. 10-105114

International Patent Publication Laid-Open No. WO 00/00956 (A) published on Jan. 6, 2000 discloses a method and apparatus for generating a control signal which can variably determine a switching timing of a power recovery circuit of a plasma display panel television. A variable range pulse generating unit generates a variable range pulse which determines an allowable maximum variable range of recovery power providing timing, and a first counter is enabled by the variable range pulse, counts clock signals, and periodically outputs a count value. A second counter and a third counter count the numbers of times of switching between a first switch and a second switch to set a first reference value and a second reference value, respectively. A rising pulse generating unit periodically compares the count value with the first reference value. When the count value and the first reference value are equal to each other, a logical level of an output signal is inverted from low to high. A falling pulse generating unit periodically compares the count value with the second reference value. When the count value and the second reference value are equal to each other, the logical level of the output signal is inverted from high to low. An AND gate calculates a logical product between output signals from the rising pulse generating unit and the falling pulse generating unit to generate a control signal. A pulse duration of the control signal is determined by the first reference value and the second reference value. The two reference values can be externally and variably determined.

Patent Document 2: WO 00/00956

DISCLOSURE OF THE INVENTION

Problem to be Solved by the Invention

In a PDP, as a pulse waveform applied to an electrode for causing discharging in a cell, a sustain pulse having an asymmetrical waveform are occasionally used. In this case, with a normal power recovery circuit, a potential of a capacitor for power recovery gradually shifts in one polar direction, or a power applied to a display electrode capacitor cannot be sufficiently recovered.

The present inventors recognize that it is desirable to realize a circuit which can sufficiently recover supplied electric energy even though a periodic pulsed voltage having an arbitrary waveform including an asymmetric waveform is applied to an electrode for display.

It is an object of the present invention to realize a circuit which can sufficiently recover electric energy supplied to a capacitance by a periodic pulsed voltage having an arbitrary waveform.

Means for Solving the Problem

According to a characteristic feature of the present invention, a charging/discharging apparatus which charges a capacitance to be charged/discharged by applying a voltage includes: a recovery capacitor for recovering electric energy which has one terminal connected to a first power supply through first switch means and another terminal connected to a second power supply through second switch means; first path forming means which has one terminal connected to a connection point between the second power supply and the other terminal of the recovery capacitor and another terminal connected to the capacitance to be charged/discharged, and charges the capacitance to be charged/discharged through a resonant inductor when the first switch means is turned on; second path forming means which has one terminal connected to a connection point between the first power supply and the one terminal of the recovery capacitor and another terminal connected to the capacitance to be charged/discharged, and discharges the capacitance to be charged/discharged through the resonant inductor when the second switch means is turned on to recover electric energy in the recovery capacitor; and control means which controls the first and second switch means and the first and second path forming means.

The present invention also relates to an electric charging/discharging method for realizing functions of the apparatus.

Effect of the Invention

According to the present invention, electric energy supplied to a capacitance by applying a pulsed voltage having an arbitrary waveform can be sufficiently recovered.

BEST MODE FOR CARRYING OUT THE INVENTION

Figure 1:
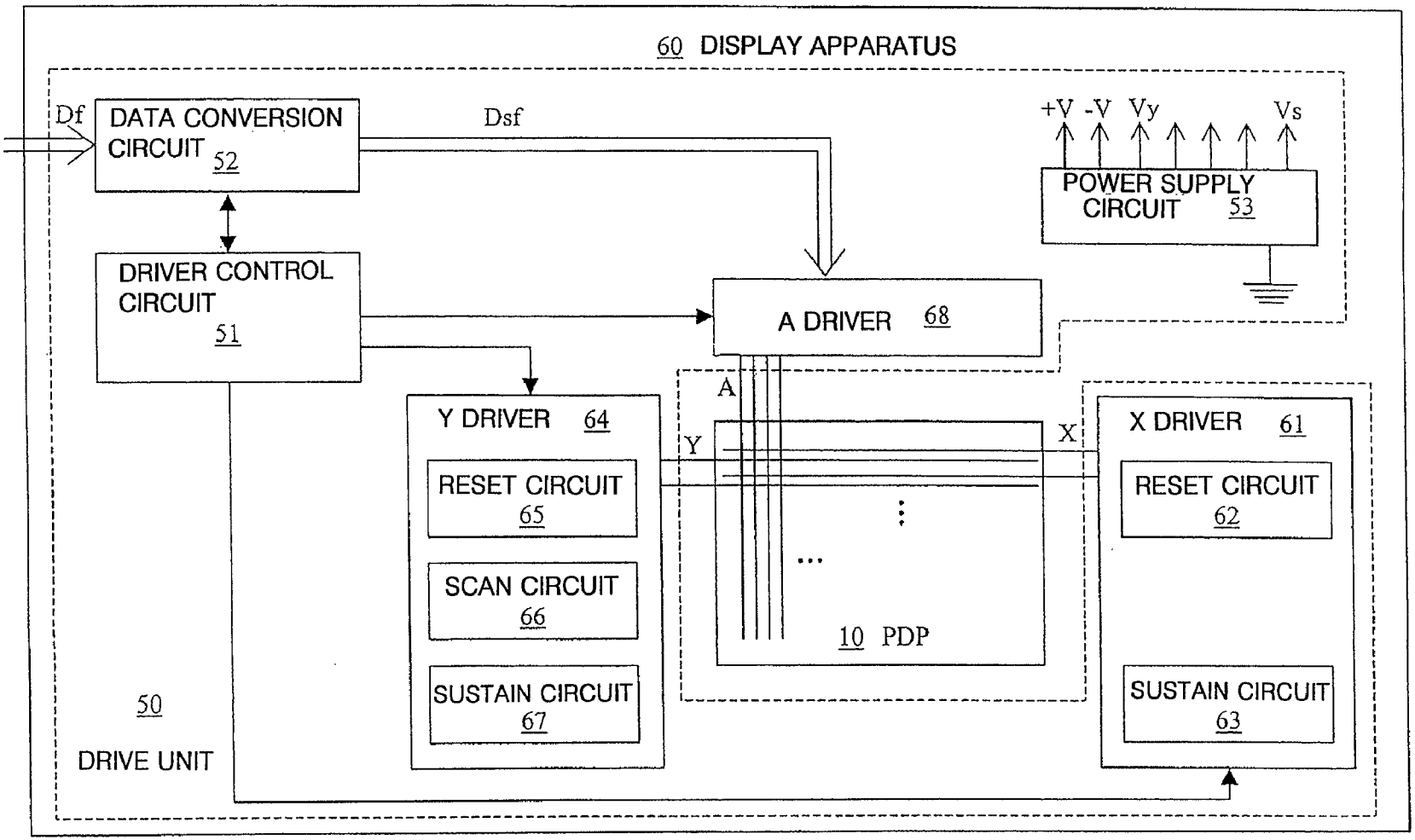
FIG. 1 shows a configuration of a typical display apparatus according to an embodiment of the present invention.

An embodiment of the present invention will be described below with reference to the accompanying drawings. Identical reference numerals denote similar constituent elements in the drawings.

FIG. 1 shows a configuration of a typical display apparatus 60 according to the embodiment of the present invention. The display apparatus 60 includes a 3-electrode surface discharge type PDP 10 having a display screen constituted by an array of m×n cells, and a drive unit 50 for causing the array cells to selectively emit light. For example, the display apparatus 60 is used in a television receiver, a monitor of a computer system, or the like.

In the PDP 10, display electrodes X and Y constituting an electrode pair for causing display discharging are arranged in parallel to each other, and an address electrode A is arranged orthogonally to the display electrodes X and Y. The display electrode X is a sustain (sustainment) electrode, and the display electrode Y is a scan (scanning) electrode. The display electrodes X and Y typically extend in a row direction or a horizontal direction of the screen, and the address electrode A extends in a column direction or a vertical direction.

The drive unit 50 includes a driver control circuit 51, a data conversion circuit 52, a power supply circuit 53, an X electrode driver circuit or an X driver circuit 61, a Y electrode driver circuit or a Y driver circuit 64, and an address electrode driver circuit or an A driver circuit 68. Depending on conditions, the drive unit 50 is packaged as a configuration of an integrated circuit which can include a ROM. Field data Df representing emission intensities of three primary colors R, G, and B are input from an external device such as a TV tuner or a computer to the drive unit 50 together with various synchronous signals. The field data Df is temporarily stored in a field memory in the data conversion circuit 52. The data conversion circuit 52 converts the field data Df into sub-field data Dsf for grayscale display to supply the sub-field data Dsf to the A driver circuit 68. The sub-field data Dsf is a set of 1-bit display data per cell. A value of each bit thereof represents whether or not light emission of each cell is necessary in a corresponding sub-field SF.

The X driver circuit 61 includes a reset circuit 62 which applies a voltage to initializing the display electrode X to equalize wall voltages of a plurality of cells constituting the PDP display screen and a sustain circuit 63 which applies a sustain pulse to the display electrode X to cause the cells to perform display discharging. The Y driver circuit 64 includes a reset circuit 65 which applies an initializing voltage to the display electrode Y, a scan circuit 66 which applies a scan pulse to the display electrode Y in addressing, and a sustain circuit 67 which applies a sustain pulse to the display electrode Y to cause the cells to perform display discharging. The A driver circuit 68 applies an address pulse to the address electrode A designated by the sub-field data Dsf depending on display data.

The driver control circuit 51 controls application of a pulse voltage and transfer of the sub-field data Dsf. The power supply circuit 53 supplies a drive power to a required portion in the unit. The driver control circuit 51 may take information representing on cells and off cells obtained by the sub-field data Dsf from the data conversion circuit 52, may determine the display electrodes X and Y related to the on cells and the off cells, and may supply data related to the display electrodes X and Y related to the off cells to the sustain circuits 63 and 67.

Figure 2:
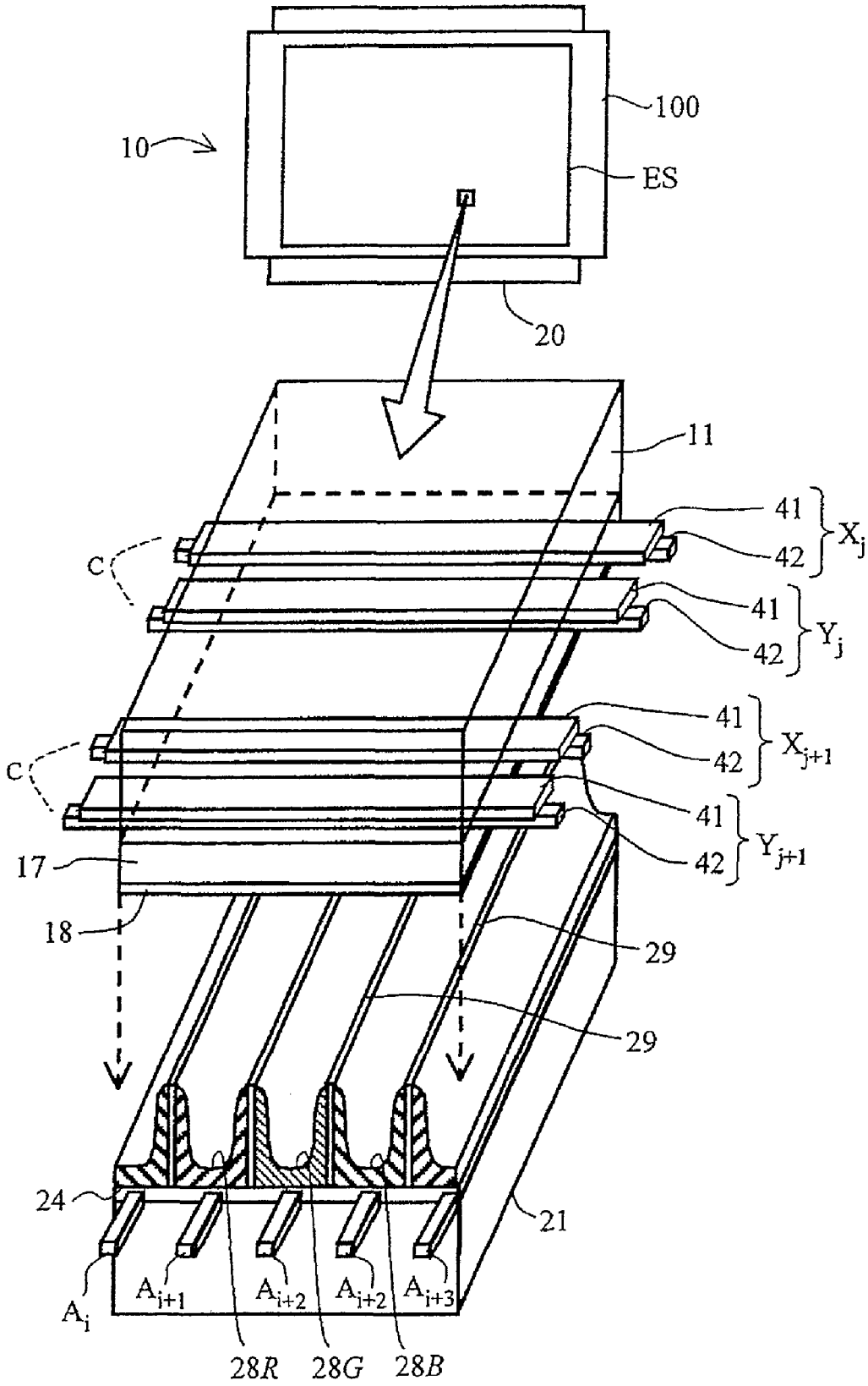
FIG. 2 shows a typical cell structure of a PDP 10.

FIG. 2 shows a typical cell structure of the PDP 10. The PDP 10 is constituted by one pair of substrate structures (structure of a glass substrate having a cell constituent element provided thereon) 100 and 20. On an internal surface of a glass substrate 11 on a front surface side, one pair of display electrodes X and Y are arranged on each row of a display screen ES constituted by n rows and m columns. In FIG. 2, subscripts j of the display electrodes X and Y denote positions on an arbitrary row, and subscripts i of address electrodes A denote positions on an arbitrary column. Each of the display electrodes X and Y is constituted by a transparent conductive film 41 forming a surface discharging gap and a metal film 42 superposed on an edge portion of the transparent conductive film 41. The display electrodes X and Y are covered with a dielectric layer 17 and a protecting layer 18. One address electrode A is arranged per column on an internal surface of a glass substrate 21 on a rear surface side. The address electrodes A are covered with a dielectric layer 24. Barriers 29 are formed on the dielectric layer 24 to partition a discharging space into sections separated by columns. The pattern of the barrier in FIG. 2 is a stripe pattern. However, the pattern may be lattice-shaped, meandering-shaped, ladder-shaped. The present invention is not limited to the shape of the barrier. Phosphorous layers 28R, 28G, and 28B for color display which cover an upper surface of the dielectric layer 24 and a side surface of the barrier 29 are locally excited by ultraviolet rays emitted from a discharge gas to emit light. Italic characters (R, G, and B) in FIG. 2 denote emission colors of phosphors. A color arrangement is a repeat pattern of R, G, and B such that a cell of each column is in the same color.

One picture (screen) is typically constituted by one frame period, one frame is constituted by two fields in interlace type scanning, and one frame is constituted by one field in progressive type scanning. In display by the PDP 10, in order to achieve color reproduction by binary light-emitting control, one field F of time series of an input image in such a field period is typically divided into a predetermined number (q) of sub-fields SF. Typically, each field F is replaced with a set of q sub-fields SF. Frequently, different weights $2^0$, $2^1$, $2^2$, . . . , $2^{q-1}$ and the like are sequentially given to the sub-fields SF, respectively, and the number of times of display discharging of each sub-field SF. Depending on combinations of (light-emitting state)/(non-light-emitting state) in sub-field units, a luminance setting of N ($=1+2^1+2^2+ \ldots +2^{q-1}$) steps can be performed to each of the colors R, G, and B. In accordance with the field configuration, a field period Tf serving as a field transfer cycle is divided into q sub-field periods Tsf, and one sub-field period Tsf can be allocated to each of the sub-fields SF. Furthermore, the sub-field period Tsf is divided into a reset period TR for initialization, an address period TA for addressing, and a display period TS for light emission. Typically, the reset period TR and the address period TA have constant lengths regardless of their weights. However, the number of pulses in the display period TS is in proportion to the weight, and the length of the display period TS is in proportion to the weight. In this case, the length of the sub-field period Tsf is in proportion to the weight of the corresponding sub-field SF.

Figure 3:
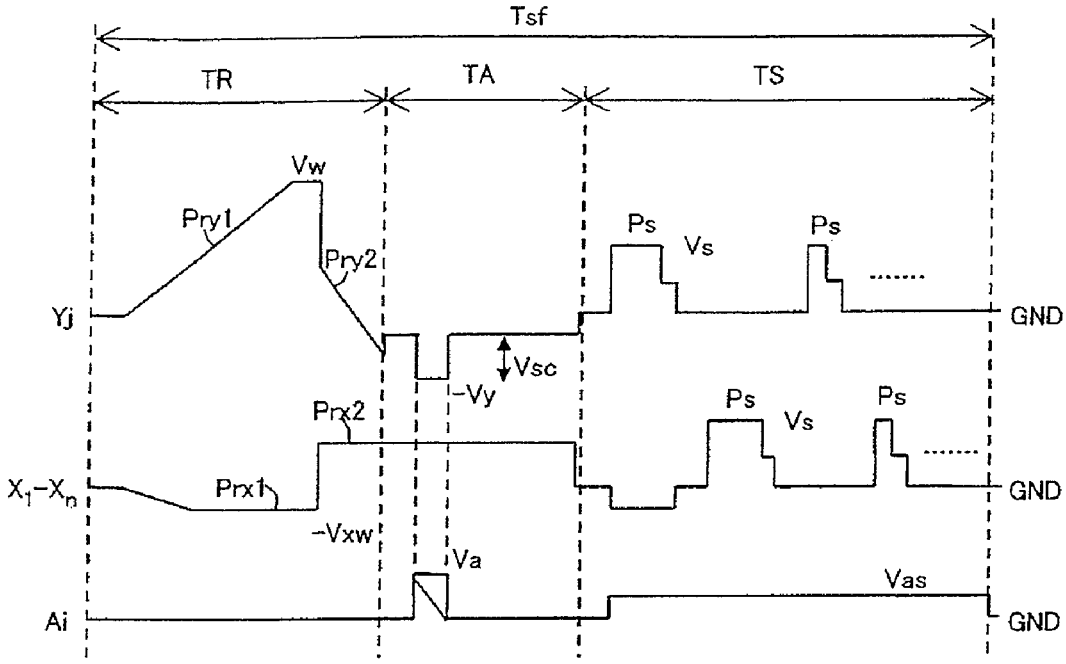
FIG. 3 illustrates schematic drive sequences of output drive voltage waveforms of an X driver circuit, a Y driver circuit, and an A driver circuit according to the embodiment of the present invention.

FIG. 3 illustrates schematic drive sequences of output drive voltage waveforms of the X driver circuit 61, the Y driver circuit 64, and the A driver circuit 68 according to the embodiment of the present invention. The waveforms in FIG. 3 are examples. The amplitudes, polarities, and timings can be variably changed.

An order of the reset period TR, the address period TA, and the sustain period TS is not changed in the q sub-fields SF, and a drive sequence is repeated every sub-field SF. In the reset period TR of each sub-field SF, a negative pulse Prx1 and a positive pulse Prx2 are sequentially applied to all the display electrodes X, and a positive pulse Pry and a negative pulse Pry2 are sequentially applied to all the display electrodes Y. The pulses Prx1, Pry1, and Pry2 are ramp waveforms or obtuse waveform pulses the amplitudes of which gradually increase at a change rate of causing minute discharging. The pulses Prx1 and Pry1 which are applied at the beginning are applied to all the cells regardless of (light-emitting state)/(non-light-emitting state) in the sub-fields SF to generate appropriate wall voltages having the same polarity in all the cells. The pulses Prx2 and Pry2 are applied to cells in which appropriate wall charges are present to enable adjusting the wall voltages to a value corresponding to a differences between a discharge start voltage and a pulse amplitude. A drive voltage applied to the cell is a composite voltage representing a difference between amplitudes of the pulses applied to the display electrodes X and Y.

In the address period TA, wall charges required to maintain light emission are formed in only a cell to emit light. When all the display electrodes X and all the display electrodes Y are biased to predetermined potentials, a negative scan pulse −Vy is applied to the display electrode Y corresponding to a selected row every row selecting period (scanning time of one row). Moment that the row is selected, an address pulse Va is applied to only an address electrode A corresponding to a selected cell to cause address discharge. More specifically, potentials of address electrodes $A_1$ to $A_m$ are binarily controlled based on the sub-field data Dsf of m columns of a selected row j. In the selected cell, discharging occurs between the display electrode Y and the address electrode A. The address discharging serves as a trigger to cause surface discharging between the display electrodes X and Y.

In the display period TS, a sustain pulse Ps having a predetermined polarity (positive polarity in the example in FIG. 3) is applied to all the display electrodes Y first. Thereafter, the sustain pulses Ps are alternately applied to the display electrodes X and the display electrodes Y. The amplitude of the sustain pulse Ps is a maintenance voltage Vs. In application of the sustain pulse Ps, surface discharging occurs in a cell in which predetermined wall charges are left. The number of times of application of the sustain pulse Ps corresponds to the weight of the sub-field SF as described above. In order to prevent unnecessary counter discharging over the entire display period TS, the address electrode A is biased to a voltage Vas having the same polarity as that of the sustain pulse Ps.

In FIG. 2, a capacitor formed by one pair of display electrodes Xj and Yj has a capacitor C. The voltages Vs of the sustain pulses Ps of two series shown in FIG. 3 are applied across one pair of display electrodes Xj and Yj by the sustain circuits 63 and 67 in FIG. 1.

Figure 4A:
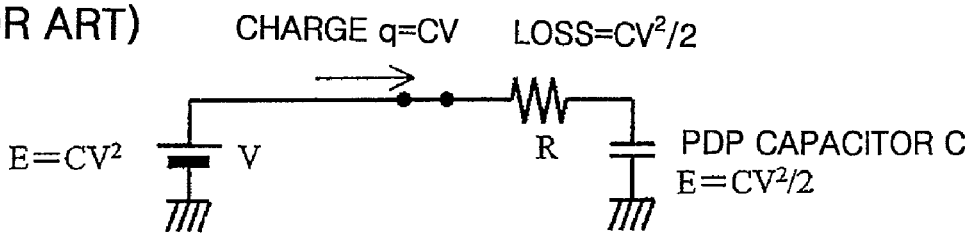
FIG.4A (PRIOR ART)
FIG. 4A is useful to explain energy loss in a resistor when electric charges are accumulated in a capacitance of a display electrode by a voltage source in a sustain circuit.

FIG. 4A is useful to explain an energy loss in a resistor R in one row (one line) used when electric charges q=CV is accumulated in the capacitor C of the display electrodes Xj and Yj by a voltage source V given by voltage Vs=V. The electric charges supplied from the voltage source V are given by q=CV, energy E supplied from a power supply is given by CV2, and electric energy accumulated in the capacitor C is given by $E=CV^2/2$. ½ of supplied electric energy is consumed by the resistor R and lost.

Figure 4B:
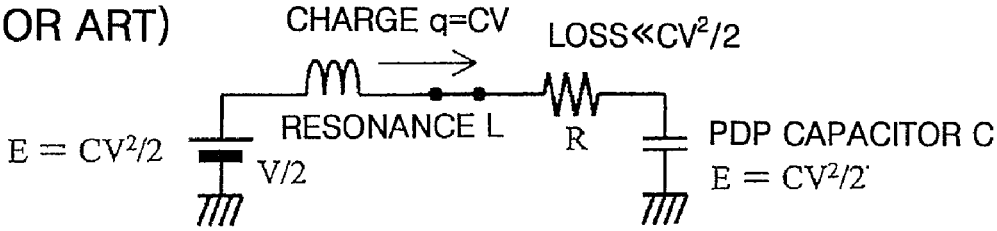
FIG.4B (PRIOR ART)
FIG. 4B is useful to explain energy loss in the resistor when the electric charges are accumulated in the capacitance of the display electrode through a resonant inductor by the voltage source.

FIG. 4B is useful to explain energy loss in the resistor R when electric charges q=CV are accumulated in the capacitor C of the display electrodes Xj and Yj through a resonant inductor L by a voltage source V/2 having a voltage Vs=V/2. The resonant inductor L and the capacitor C constitute a resonant circuit, and the energy loss in the resistor R is sufficiently smaller than $CV^2/2$.

Figure 5A:
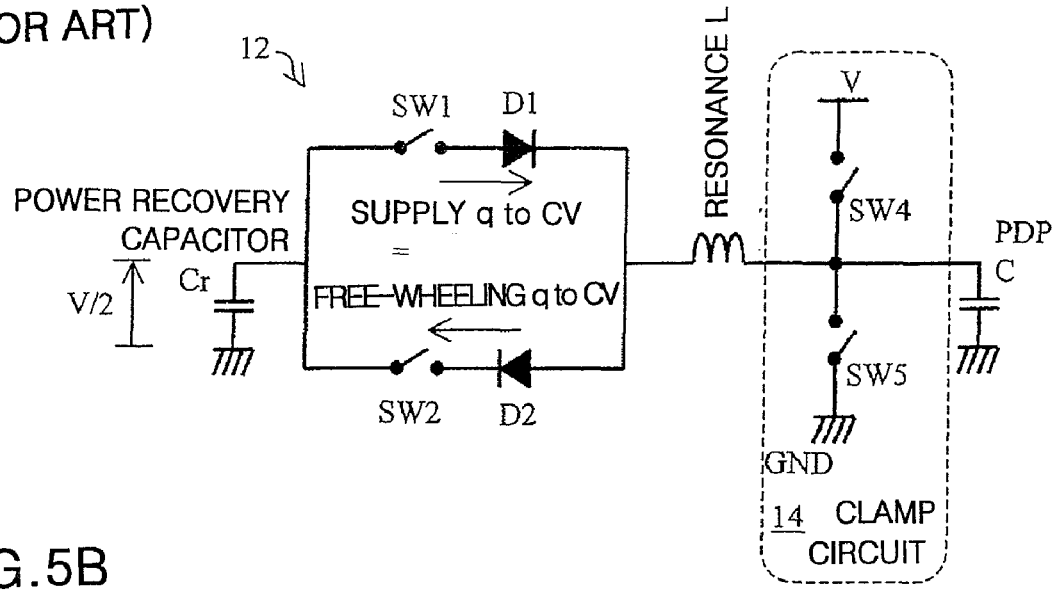
FIG.5A (PRIOR ART)
FIG. 5A shows a conventional pulse power supply and recovery circuit having an electric energy recovery function, i.e., a power recovery function, used in the sustain circuit.
Figure 5B:
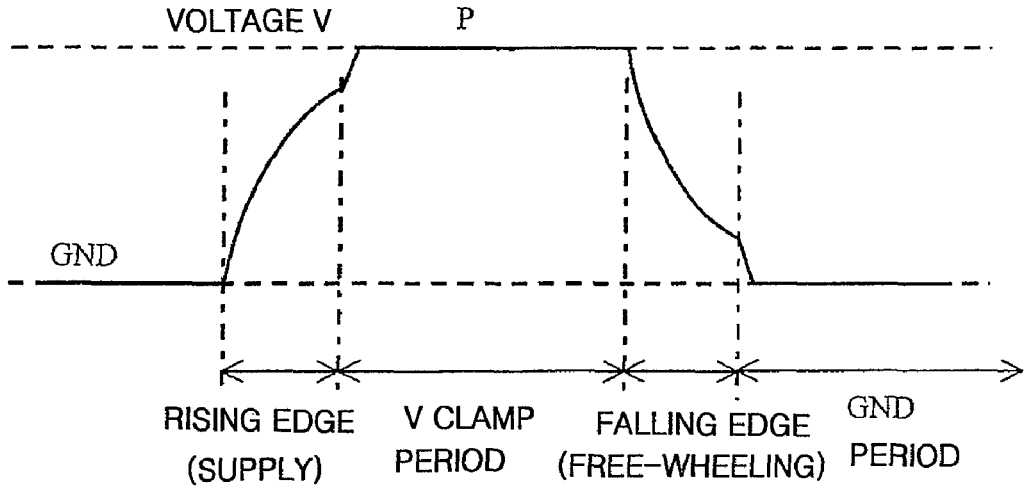
FIG.5B (PRIOR ART)
FIG. 5B shows a change in voltage between both terminals of a display electrode capacitor when the pulse power supply and recovery circuit in FIG. 5A in pulse application is used.

FIG. 5A shows conventional pulse power supply and recovery circuit 10 having an electric energy recovery function, i.e., a power recovery function used in the sustain circuits 63 and 67. FIG. 5B shows a change in voltage between both the terminals of the display electrode capacitor (capacitance) C when the pulse power supply and recovery circuit 10 in FIG. 5A in application of a pulse.

In FIG. 5A, a pulse power supply and recovery circuit 12 includes: a power recovery capacitor Cr having one display electrode grounded and a large capacitance; diodes D1 and D2 which have one terminals connected to the capacitor Cr in series with each other and which are connected to the capacitor Cr through switches SW1 and SW2 to have opposite polarities; a resonant inductor L which has one terminal connected to a connection point between the other terminals of the diodes D1 and D2 and which has the other terminal connected to one electrodes of one or two or more pairs of display electrodes of the capacitor C; and a clump circuit 14 which connects a constant voltage source V having a predetermined voltage V to a connection point between the other terminal of the resonant inductor L and one electrode of the display electrode of the pairs of the display electrodes and which connects the connection point to a ground point GND through a switch SW5.

Referring to FIGS. 5A and 5B, assume that electric charges having the voltage V/2 are accumulated in the power recovery capacitor Cr first and that no electric charges are accumulated in the display electrode capacitor C. When the switch SW1 is turned on at the start of a rising period of a pulse P, a supply current flows from the capacitor Cr to the display electrode capacitor C through the switch SW1 and the resonant inductor L, and the electric charges q to CV are accumulated in the capacitor C. The voltage of the C rises, and a rising edge of the pulse P is formed. When the voltage of the capacitor C almost reaches a peak voltage, a switch SW4 of the clump circuit 14 is turned on. Because of the diode D1, a current does not flow in a direction opposite to a direction of the supply current. Therefore, the switch SW1 is turned off at an arbitrary timing until the turn-off timing of the switch SW4 after the voltage reaches the peak voltage. The peak voltage is slightly lower than the voltage V. In a clamp period, a voltage source of the clump circuit 14 clamps the voltage of the capacitor C to the voltage V to maintain the voltage of the capacitor C at the voltage V. Thereafter, the switch SW4 is turned off.

When the switch SW2 is turned on at the start of the rising period of the pulse P, a free-wheeling current flows from the capacitor C to the recovery capacitor Cr through the switch SW2 and the resonant inductor L, the electric charges q to CV are additionally accumulated in the power recovery capacitor Cr, the voltage of the capacitor C falls, and a falling edge of the pulse P is formed. When the voltage of the capacitor C almost reaches a negative peak voltage, the switch SW5 is turned on. The peak voltage is slightly higher than a ground potential of 0 V. In the falling period, a ground point GND of the clump circuit 14 clamps the voltage of the capacitor C to the ground potential of 0 V and maintains the voltage of the capacitor C at the ground potential of 0 V. Because of the diode D2, a current does not flows in an opposite direction of the free-wheeling current. Therefore, the switch SW2 is turned off at an arbitrary timing until the turn-off timing of the switch SW5 after the voltage reaches the peak voltage. Thereafter, the switch SW5 is turned off.

In this manner, electric charges, i.e., most of power supplied from the capacitor Cr to the capacitor C is recovered. The clump circuit 14 compensates for the voltage of the capacitor C to make the voltage equal to the predetermined voltage V. As described above, when the waveforms of the pulse P at the rising edge and the falling edge are symmetrical, power supplied to the capacitor C is sufficiently recovered.

Figure 6:
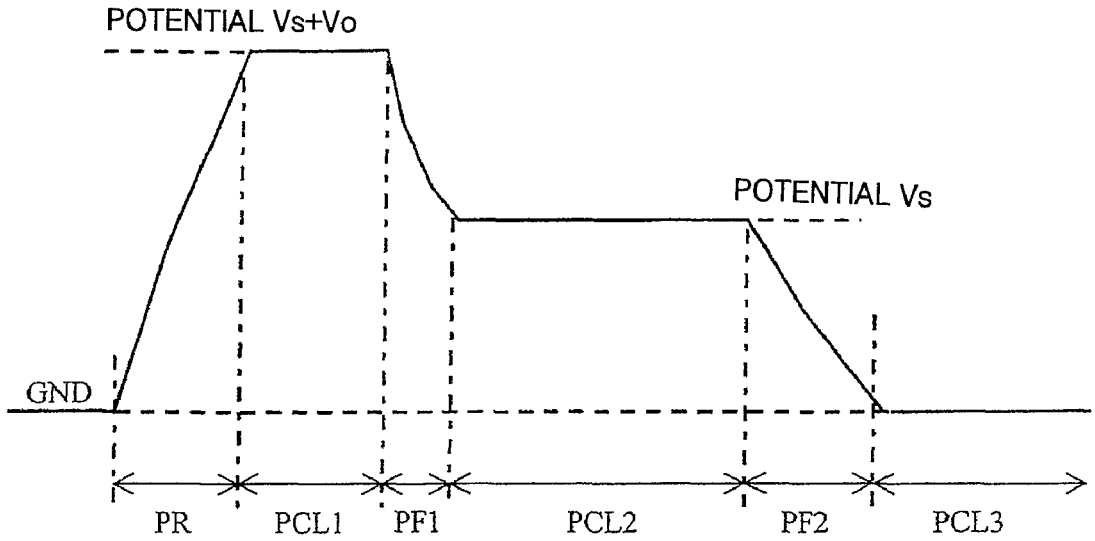
FIG. 6 shows a schematic waveform of a sustain pulse voltage frequently used.

FIG. 6 shows a schematic waveform of a frequently used sustain pulse voltage. In the waveform, a voltage between display electrodes rises from a ground potential of 0 V to almost a potential Vs+Vo at a rising edge PR of the pulse, is maintained at the potential Vs+Vo in a clamp period PCL1, decreases from the potential Vs+Vo to the potential Vs at a discharge falling edge PF1, is maintained at the potential Vs in a clamp period PCL2, falls from the potential Vs to almost a ground potential of 0 V at a falling edge PF2 of the pulse, and is maintained at the ground potential of 0 V in a clamp period PCL3. Voltage Vs=voltage Vo may be satisfied.

In the power recovery circuit 12 in FIG. 5A, when the pulse having the waveform shown in FIG. 6 is used, electric charges recovered from the capacitor C to the capacitor Cr at a falling edge of the pulse are considerably smaller than electric charges supplied from the capacitor Cr to the capacitor C at the rising edge of the pulse, the voltage of the electric charges accumulated in the power recovery capacitor Cr gradually positively shifts from V/2. Therefore, for the pulse having the waveform shown in FIG. 6, the power recovery circuit 12 cannot be used. As an alternative configuration, the circuit shown in FIG. 5A may be able to be modified to recover only some of the power supplied to the display electrode capacitor C between the ground potential GND and the potential Vs. However, the power is not sufficiently recovered.

Most of the electric charges supplied from the capacitor Cr at the rising edge of the pulse are desirably recovered by the capacitor Cr.

Figure 7:
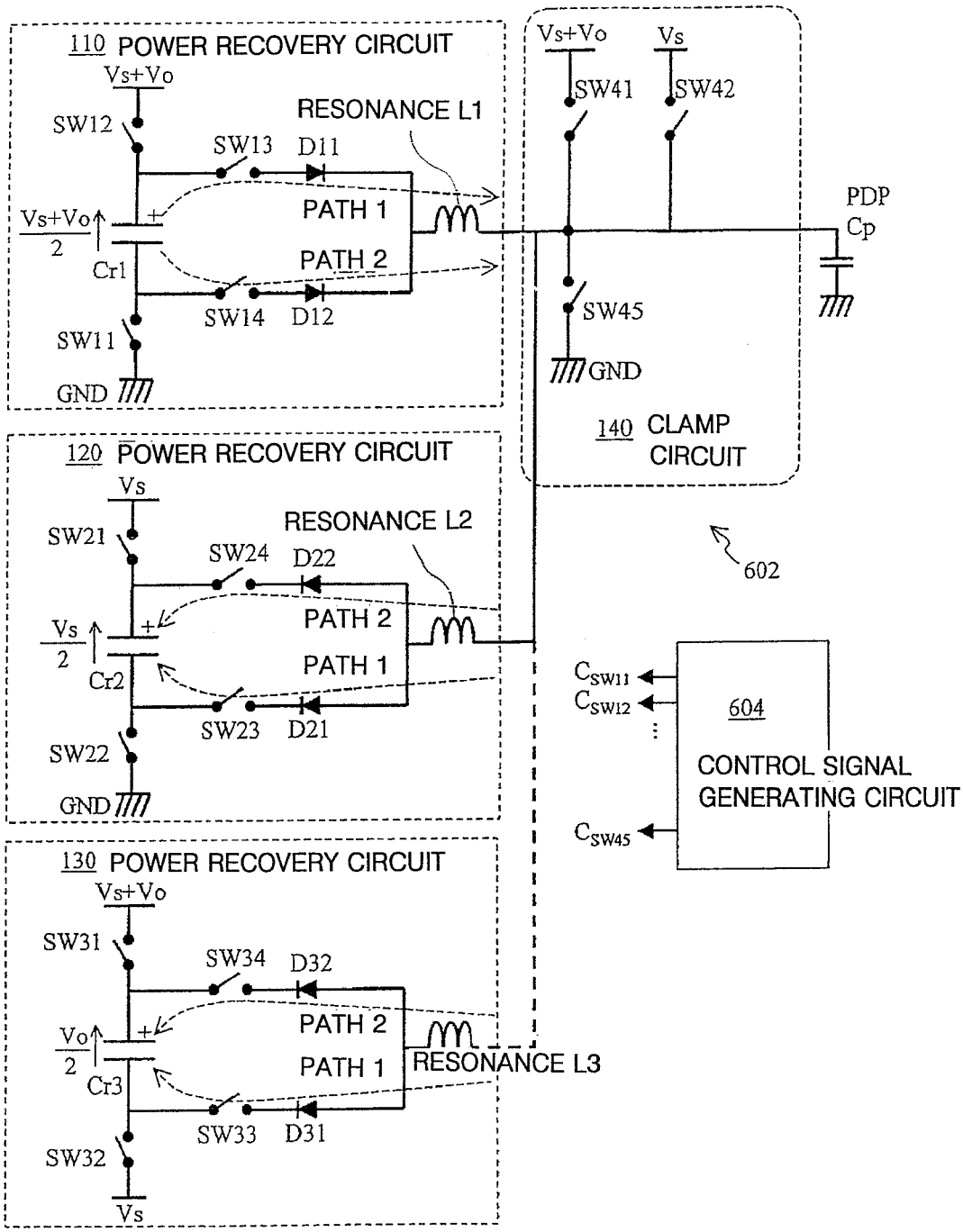
FIG. 7 shows a pulse voltage applying circuit which applies a pulse voltage to one pair of the display electrodes according to the embodiment of the present invention.

FIG. 7 shows a pulse voltage applying circuit 602 which applies pulse voltages to one or two or more pairs of display electrodes X and Y having a capacitor Cp according to the embodiment of the present invention. The pulse voltage applying circuit 602 includes a pulse power supply and recovery circuit 110 which supplies and recovers power at the final falling edges of the pair of pulses P1 and P2, a clamp circuit 140 which clamps a voltage between the display electrodes X and Y to a predetermined voltage, and a control signal generating circuit 604 which generates a signal for controlling ON/OFF operations of switches SW11 to SW45 in the pulse power supply and recovery circuits 110 and 120 and the clamp circuit 140. The pulse voltage applying circuit 602 may include a pulse power supply and recovery circuit 130 which supplies and recovers power at the first falling edges of the pair of pulses P1 and P2. The switches SW11 to SW45 may be constituted by transistors.

Figure 8A:
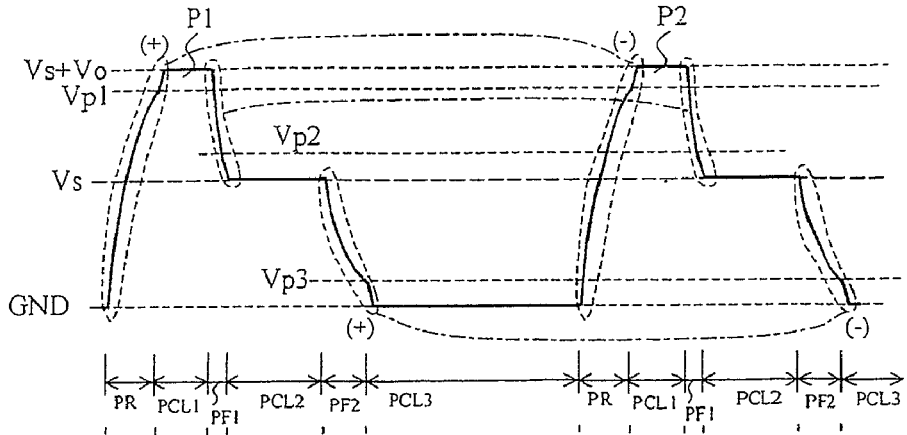
FIG. 8A shows a waveform of a pulse applied to a capacitance between the display electrodes of a PDP according to the embodiment of the present invention.
Figure 8B:
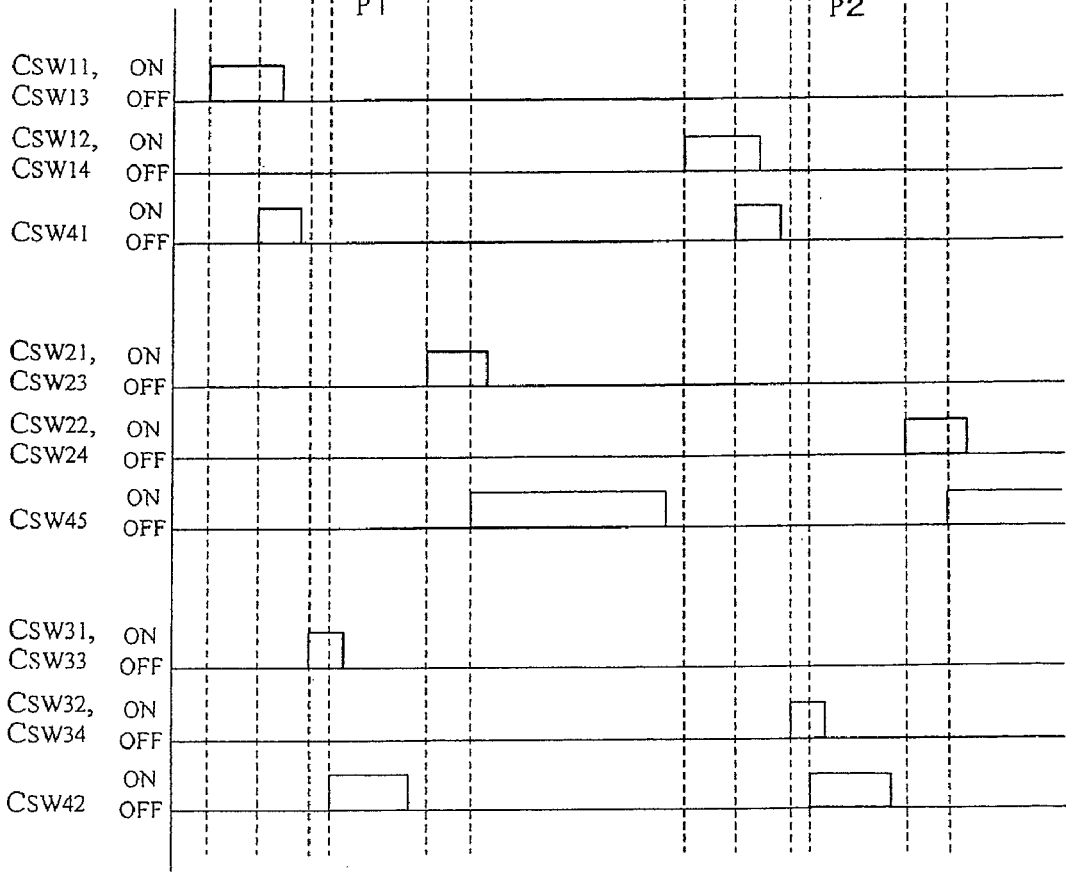
FIG. 8B shows an ON/OFF state of a control signal in a control signal generating circuit in FIG. 7 according to the embodiment of the present invention.
Figure 9A:
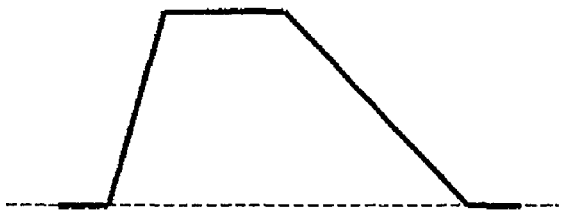
FIGS. 9A to 9F show examples of various pulse waveforms to which the present invention can be applied.
Figure 9B:
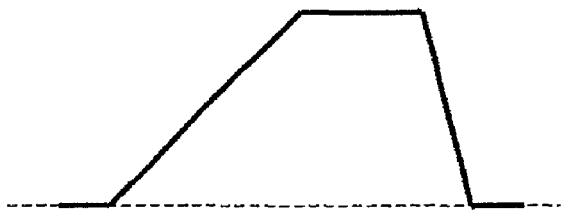
Figure 9C:
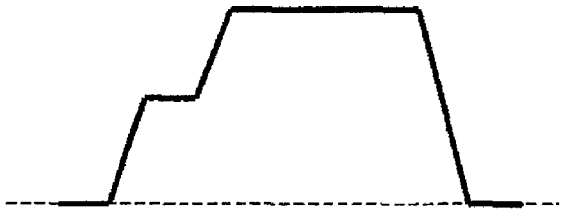
Figure 9D:
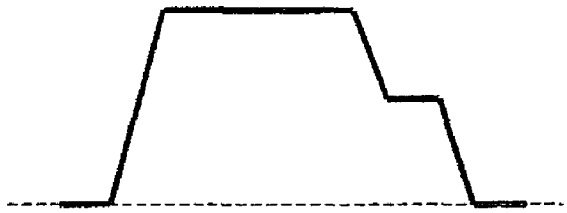
Figure 9E:
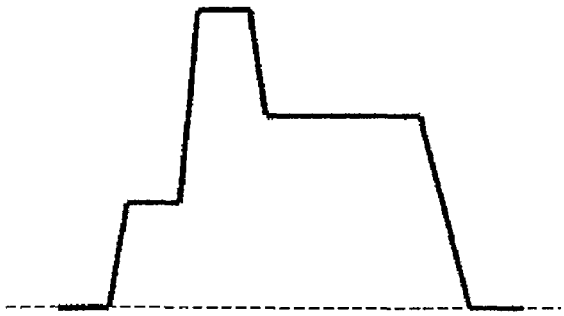
Figure 9F:
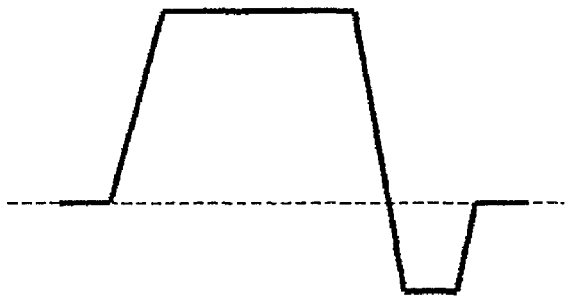

FIG. 8A shows waveforms of one pair of pulses P1 and P2 in a cyclic pulse applied to the capacitor Cp between the display electrodes of the PDP 10. FIG. 8B shows ON/OFF states of control signals $C_{SW11}$ to $C_{SW45}$ of the control signal generating circuit 604 shown in FIG. 7 to control the switches SW11 to SW45.

The pulse power supply and recovery circuits 110 and 120 in FIG. 7 perform the following operations. That is, power is supplied by using a recovery capacitor Cr1 at one of the rising edges of the pair of pulses P1 and P2, and the power is recovered at the other of the rising edges. Power is supplied at one of the falling edges of the pair of pulses by using a recovery capacitor Cr2, and the power is recovered at the other of the falling edges.

The pulse power supply and recovery circuit 110 includes a power recovery capacitor Cr1 having one terminal connected to a ground point GND through the switch SW11 and the other terminal connected to a constant voltage source Vs+Vo through the switch SW12, a diode D11 having an anode (positive pole) connected to a connection point between one terminal of the capacitor Cr1 and the switch SW12 through the switch SW13, a diode D12 having an anode connected to a connection point between the other terminal of the capacitor Cr1 and the switch SW11 through the switch SW14, and a resonant inductor L1 having one terminal connected to a connection point between the cathodes (negative poles) of the diodes D11 and D12 and the other terminal connected to one display electrodes (X or Y) of one or two or more pairs of display electrodes X and Y of the capacitor Cp.

The pulse power supply and recovery circuit 120 includes a power recovery capacitor Cr2 having one terminal connected to the constant voltage source Vs through the switch SW21 and the other terminal connected to the ground point GND through the switch SW22, a diode D21 having a cathode connected to a connection point between one terminal of the recovery capacitor Cr2 and the switch SW22 through the switch SW23, a diode D22 having a cathode connected to a connection point between the other terminal of the recovery capacitor Cr2 and the switch SW21 through the switch SW24, and a resonant inductor L2 having one terminal connected to a connection point between the diode D21 and the diode D22 and the other terminal connected to one terminals of one or two or more pairs of display electrodes X and Y of the capacitor Cp.

The pulse power supply and recovery circuit 130 includes a power recovery capacitor Cr13 having one terminal connected to the constant voltage source Vs+Vo through the switch SW31 and the other terminal connected to the constant voltage source Vs through the switch SW22, a diode D31 having a cathode connected to a connection point between one terminal of the capacitor Cr3 and the switch SW32 through the switch SW33, a diode D32 having a cathode connected to a connection point between the other terminal of the capacitor Cr3 and the switch SW31 through the switch SW34, and a resonant inductor L3 having one terminal connected to a connection point between the anodes of the diodes D31 and D32 and the other terminal connected to one display electrodes of the pairs of display electrodes X and Y of the capacitor Cp.

The clamp circuit 140 includes a constant voltage source having a predetermined voltage Vs+Vo and connected to a connection point between a connection point between the resonant inductors L1, L2, and L3 and one display electrodes of the resonant inductors through the switch SW41, a constant voltage source having a predetermined voltage Vs and connected to the connection point through the switch SW42, and a ground point GND connected to the connection point through the switch SW45.

An operation will be described below. In the pulse power supply and recovery circuit 12 in FIG. 6A, in stationary operation stationary operation state set after a power supply of the display apparatus 60 in FIG. 1 is turned on to repeat charging/discharging of the capacitors Cr1 and Cr2, it is assumed that electric charges of almost a voltage of (Vs+Vo)/2 are accumulated in the capacitor Cr1, that electric charges of a voltage of Vs/2 are accumulated in the recovery capacitor Cr2, and that no electric charges are accumulated in the display electrode capacitor Cp. The capacitors Cr1 and Cr2 have capacitances which are sufficiently larger than that of the capacitor Cp.

In the rising period PR of the pulse P1, when the switches SW11 and SW13 are turned on according to the control signals $C_{SW11}$ and $C_{SW13}$ from the control signal generating circuit 604, a current flows from the capacitor Cr1 to the display electrode capacitor Cp through the switch SW13, the diode D11, and the resonant inductor L1 which constitute a path 1, and a voltage between both the terminals of the capacitor Cr1 slightly decreases to form a rising edge of the pulse P1. When the voltage of the capacitor Cp reaches a peak potential Vp1, the switch SW41 of the clamp circuit 140 is turned on according to the control signal $C_{SW41}$. Because of the diode D11, a current does not flow in a direction opposite to a direction of the supply current. Therefore, the switches SW11 and SW13 are turned off at an arbitrary timing until a turn-off timing of the switch SW41 after the voltage reaches the peak voltage. The peak potential Vp1 is slightly lower than Vs+Vo. In the rising period PR, electric charges q to $C_{r1}$ (Vs+Vo)/2, i.e. power, are supplied from the capacitor Cr1 to the capacitor Cp. In the clamp period PCL1, the voltage source Vs+Vo of the clamp circuit 140 clamps the voltage of the capacitor Cp to the voltage Vs+Vo, and maintains the display electrode capacitor Cp at the potential Vs+Vo. Thereafter, the switch SW41 is turned off according to the control signal $C_{SW41}$. In the first falling period PF1 of the pulse P1, the switch SW42 is turned on according to the control signal $C_{SW42}$, and the pulse P1, i.e., the voltage of the capacitor Cp, falls to the voltage Vs. In the subsequent final falling period PF2 of the pulse P1, the pulse P1, i.e., the voltage of the capacitor Cp, falls to the ground potential GND.

In the rising period PR of the pulse P2, when the switches SW12 and SW14 are turned on according to the control signals $C_{SW12}$ and $C_{SW14}$ from the control signal generating circuit 604, a current flows from the capacitor Cr1 to the display electrode capacitor Cp through the switch SW14, the diode D12, and the resonant inductor L1 which constitute a path 2, a voltage between both the terminals of the capacitor Cr1 slightly increases, and a rising edge of the pulse P2 is formed. When the voltage of the capacitor Cp reaches a peak potential Vp1, the switch SW41 of the clamp circuit 140 is turned on according to the control signal $C_{SW41}$. Because of the diode D12, a current does not flow in a direction opposite to a direction of the supply current. Therefore, the switches SW12 and SW14 are turned off at an arbitrary timing until a turn-off timing of the switch SW41 after the voltage reaches the peak voltage. In the rising period RP, electric charges q to Cr1 (Vs+Vo)/2, i.e. power, are recovered from the capacitor Cp to the capacitor Cr1. In the clamp period PCL1, the voltage source Vs+Vo of the clamp circuit 140 clamps the voltage of the capacitor Cp to the voltage Vs+Vo and maintains the display electrode capacitor Cp at the potential Vs+Vo. Thereafter, the switch SW41 is turned off according to the control signal Csw41. In the first falling period PF1 of the pulse P2, the switch SW42 is turned on according to the control signal CSW42, and the pulse P2, i.e., the voltage of the capacitor Cp falls to the voltage Vs. In the subsequent final falling period PF2 of the pulse P2, the pulse P1, i.e., the voltage of the capacitor Cp falls to the ground potential GND.

In the final falling period PF2 to the ground potential GND of the pulse P1, when the switches SW21 and SW23 are turned on according to the control signals $C_{SW21}$ and $C_{SW23}$, a current flows from the display electrode capacitor Cp to the display electrode capacitor Cr2 through the switch SW23, the diode D21, and the resonant inductor L2 which constitute a path 1, a voltage between both the terminals of the capacitor Cr2 slightly decreases, and a final falling edge of the pulse P1 is formed. When the voltage of the capacitor Cp reaches a peak potential Vp3, the switch SW45 of the clamp circuit 140 is turned on according to the control signal $C_{SW45}$. Because of the diode D21, a current does not flow in a direction opposite to a direction of the supply current. Therefore, the switches SW21 and SW23 are turned off at an arbitrary timing until a turn-off timing of the switch SW45 after the voltage reaches the peak voltage. The peak voltage Vp3 is slightly higher than the potential GND. In the falling period PF2, electric charges q to $C_{r2}$VS/2, i.e. power, are supplied from the capacitor Cr2 to the capacitor Cp. In the clamp period PCL2, the ground potential GND of the clamp circuit 140 clamps the voltage of the capacitor Cp to the potential GND (0 V) and maintains the display electrode capacitor Cp at the ground potential GND. Thereafter, the switch SW45 is turned off according to the control signal $C_{SW45}$.

In the final falling period PF2 to the ground potential GND of the pulse P2, when the switches SW22 and SW24 are turned on according to the control signals $C_{SW22}$ and $C_{SW24}$, a current flows from the display electrode capacitor Cp to the display electrode capacitor Cr2 through the switch SW24, the diode D22, and the resonant inductor L2 which constitute a path 2, a voltage between both the terminals of the capacitor Cr slightly increases, and a falling edge of the pulse P2 is formed. When the voltage of the capacitor Cp reaches the peak potential Vp3, the switch SW45 of the clamp circuit 140 is turned on according to the control signal $C_{SW45}$. Because of the diode D22, a current does not flow in a direction opposite to a direction of the supply current. Therefore, the switches SW22 and SW24 are turned off at an arbitrary timing until a turn-off timing of the switch SW45 after the voltage reaches the peak voltage. In the falling period PF2, electric charges q to $C_{r2}$VS/2, i.e., power are recovered from the capacitor Cp to the capacitor Cr2. In the clamp period PCL2, the potential GND of the clamp circuit 140 clamps the voltage of the capacitor Cp to the ground potential GND and maintains the display electrode capacitor Cp at the ground potential GND. Thereafter, the switch SW45 is turned off according to the control signal $C_{SW45}$.

As described above, the driver control circuit 51 supplies data related to the display electrodes X and Y related to an off cell to the sustain circuits 63 and the sustain circuit 67. In the first falling period PF1 of first discharging of a sustain pulse, electric energy may be supplied to the capacitor Cp between the display electrodes X and Y related to the off cell and recovered. In this case, when the pulse power supply and recovery circuit 130 is arranged, the control signal generating circuit 604 supplies control signals to the switches SW31 to SW42 in a sustain period at a low load, i.e., to apply application voltages from the power recovery capacitor Cr3 to only cells in a row in which cells at a predetermined percentage of all the cells, for example, cells the number of which is ½ or more the total number do not emit light, i.e., do not perform address discharging. As a matter of course, regardless of a display load, electric energy may be supplied to and recovered from all the lines at once in the first discharge falling period PF1 of a sustain pulse. In this case, the pulse power supply and recovery circuit 130 is arranged to supply control signals to the switches SW31 to SW42 such that application voltages are applied from the capacitor Cr3 to all the display electrodes. It is assumed that electric charges of a voltage Vo/2 are accumulated in the power recovery capacitor Cr3.

In the first falling period PF1 to the potential Vs of the pulse P1, when the switches SW31 and SW33 are turned on according to the control signals Csw31 and CSw33, a current flows from the display electrode capacitor Cp to the capacitor Cr3 through the switch SW33, the diode D31, and the resonant inductor L3 which constitute a path 1, a voltage between both the terminals of the capacitor Cr3 slightly decreases, and a first falling edge of the pulse P1 is formed. When the voltage of the capacitor Cp reaches a peak potential Vp2, the switch SW42 of the clamp circuit 140 is turned on according to the control signal $C_{SW42}$. Because of the diode D31, a current does not flow in a direction opposite to a direction of the supply current. Therefore, the switches SW31 and SW33 are turned off at an arbitrary timing until a turn-off timing of the switch SW42 after the voltage reaches the peak voltage. The peak voltage Vp2 is slightly higher than the potential Vs. In the falling period PF1, electric charges q to $C_{r3}$Vo/2, i.e., power are supplied from the capacitor Cr3 to the capacitor Cp. In the clamp period PCL2, the potential Vs of the clamp circuit 140 clamps the voltage of the capacitor Cp to the potential Vs and maintains the display electrode capacitor Cp at the potential Vs. Thereafter, the switch SW42 is turned off according to the control signal $C_{SW42}$.

In the first falling period PF1 to the potential Vs of the pulse P2, when the switches SW32 and SW34 are turned on according to the control signals $C_{SW32}$ and $C_{SW34}$, a current flows from the display electrode capacitor Cp to the capacitor Cr3 through the switch SW32, the diode D32, and the resonant inductor L3 which constitute a path 2, a voltage between both the terminals of the capacitor Cr3 slightly increases, and a first falling edge of the pulse P2 is formed. When the voltage of the capacitor Cp reaches a peak potential Vp2, the switch SW42 of the clamp circuit 140 is turned on according to the control signal $C_{SW42}$. Because of the diode D32, a current does not flow in a direction opposite to a direction of the supply current. Therefore, the switches SW32 and SW34 are turned off at an arbitrary timing until a turn-off timing of the switch SW42 after the voltage reaches the peak voltage. In the falling period PF1, since the capacitor Cp is not discharged, electric charges q to $C_{r3}$Vo/2, i.e., power are recovered from the capacitor Cp to the capacitor Cr3. In the clamp period PCL2, the potential Vs of the clamp circuit 140 clamps the voltage of the capacitor Cp to the potential Vs and maintains the display electrode capacitor Cp at the potential Vs. Thereafter, the switch SW42 is turned off according to the control signal $C_{SW42}$.

In the pulse power supply and recovery circuit 110, the switch SW13 and the diode D11 may be realized by one transistor, and the switch SW14 and the diode D12 may be realized by one transistor. Similarly, in the pulse power supply and recovery circuit 120, the switch SW23 and the diode D21 may be realized by one transistor, and the switch SW24 and the diode D22 may be realized by one transistor. The same is applied to the pulse power supply and recovery circuit 130. The diodes D11, D12, D21, D22, D31, D32, and the like may not be provided. In such a case, the turn-off timings of the switches connected to the anodes of the respective diodes must be set to time of reaching peak voltages in the processes in the respective paths.

In place of the resonant inductor L1 arranged in the two paths 1 and 2 as a common element, resonant inductors may be independently arranged in the paths 1 and 2 in series with each other. In place of the resonant inductor L2 arranged in the two paths 1 and 2 as a common element, resonant inductors may be independently arranged in the paths 1 and 2 in series with each other. The same is applied to the pulse power supply and recovery circuit 130. As an alternative configuration, in the pulse power supply and recovery circuits 110, 120, and 130, some equal inductances of the inductances of the resonant inductors L1, L2, and L3 may be replaced with one common inductor. As an alternative configuration, in place of the resonant inductors L1, L2, and L3, one common inductor may be arranged.

In the pulse power supply and recovery circuit 110, in place of the switches SW13 and SW14, a changeover switch having one terminal connected to the capacitor Cp and the other terminal switched between the path 1 and the path 2 may be arranged. The same is also applied to the recovery circuits 120 and 130.

In this manner, according to the embodiment, in one pair of pulses, power is supplied from the capacitors Cr1 and Cr2 to the display electrode capacitor Cp, and most of power can be recovered from the capacitor Cp to the capacitors Cr1 and Cr2. Except for power consumed in sustain discharging, some degree of power supplied to the display electrodes X and Y can be recovered to the power recovery capacitor Cr3. In this manner, a power consumption of the display apparatus 10 can be suppressed to a low level.

According to another embodiment, only one or two of the pulse power supply and recovery circuits 110, 120, and 130 may be arranged in each of the sustain circuits 63 and 67.

It will be understood by an expert in this field that the present invention can be applied not only to one pair of pulses having asymmetrical waveforms but also to one pair of pulses having normal symmetrical waveforms.

FIGS. 9A to 9F show examples of various pulses to which a pulse power supply and recovery circuit 110 according to the present invention can be applied. In the pulse in FIG. 9A, an inclination of a rising edge is sharp, and an inclination of a falling edge is moderate. In the pulse in FIG. 9B, an inclination of a rising edge is moderate, and an inclination of a falling edge is sharp. In the pulse in FIG. 9C, a rising edge is step-like. In the pulse in FIG. 9D, a falling edge is a step-like. In the pulse in FIG. 9E, a rising edge and a falling edge are step-like. The pulse in FIG. 9F, a falling edge reaches the reverse polarity, and has a rising edge reaching a ground potential.

The embodiments described above, a PDP is merely cited as a typical example. Combinations of the constituent elements of the embodiments, modifications of the embodiments, and variations of the embodiments are apparent to persons skilled in the art. It is apparent to the persons skilled in the art that the embodiments can be variously modified without departing from the principle of the present invention and the spirit and scope of the present invention described in the scope of the invention. For example, the present invention can be applied to an inorganic EL or electric paper which displays letters or the like by accumulating electric charges by applying a voltage thereto.

The invention claimed is:

1. A charging/discharging apparatus for charging a capacitance to be charged/discharged by applying a voltage, the apparatus comprising:

a recovery capacitor for recovering electric energy, having one terminal connected to a first power supply through first switch means and another terminal connected to a second power supply through second switch means;

first path forming means, having one terminal connected to a connection point between the second power supply and the other terminal of the recovery capacitor and another terminal connected to the capacitance to be charged/discharged, for charging the capacitance to be charged/discharged through a resonant inductor when the first switch means is turned on;

second path forming means, having one terminal connected to a connection point between the first power supply and the one terminal of the recovery capacitor and another terminal connected to the capacitance to be charged/discharged, for discharging the capacitance to be charged/discharged through the resonant inductor when the second switch means is turned on to recover electric energy in the recovery capacitor;

a third capacitor for recovering electric energy having one terminal connected to a third power supply through third switch means and another terminal connected to the first power supply through fourth switch means;

third path forming means, having one terminal connected to a connection point between the third power supply and the one terminal of the third capacitor and another terminal connected to the capacitance to be charged/discharged, for charging the capacitance to be charged/discharged through the resonant inductor when the third switch means is turned on;

fourth path forming means, having the one terminal connected to a connection point between the fourth power supply and the other terminal of the third capacitor and the other terminal connected to the capacitance to be charged/discharged, for discharging the capacitance to be charged/discharged through the resonant inductor when the fourth switch means is turned on to recover electric energy to the third capacitor; and control means for controlling the first, second, third, and fourth switch means and the first, second, third, and fourth path forming means.

2. The charging/discharging apparatus according to claim 1, wherein the first power supply and the fourth power supply have potentials equal to each other.

3. A display apparatus comprising the charging/discharging apparatus according to any one of claims 1 to 2, wherein the capacitance to be charged/discharged is constituted by at least one cell constituting a display screen.

4. A plasma display panel for charging to move electric charges from a recovery capacitor for recovering electric energy to a cell constituting a screen, and recovering power to move the electric charges from the cell to the recovery capacitor, the panel comprising:

the recovery capacitor having one terminal connected to a first power supply through first switch means and another terminal connected to a second power supply through second switch means;

first path forming means having one terminal connected to the other terminal of the recovery capacitor and another terminal connected to an electrode for applying a voltage to the cell, the first path forming means for charging the cell through a resonant inductor when the first switch means is turned on; and second path forming means having one terminal connected to the one terminal of the recovery capacitor and another terminal connected to the electrode for applying a voltage to the cell, the second path forming means for discharging the cell through the resonant inductor when the second switch means is turned on to recover electric energy to the recovery capacitor, wherein the first path forming means is activated when the first switch means is turned on to change a first potential into a second potential in a first application pulse to the cell, the first switch means is turned off, the second path forming means is activated when the second switch means is turned on to change the first potential into the second potential in a second application pulse different from the first application pulse to the cell.

5. A method of charging/discharging a cell constituting a screen of a plasma display panel, the method comprising:

connecting one terminal of a recovery capacitor to a first power supply in a rising period of a first pulse applied to the cells to charge a capacitance to be charged/discharged from another terminal of the recovery capacitor through an resonant inductor, and connecting the other terminal of the recovery capacitor to a second power supply in a rising period of a second pulse different from the first pulse applied to the cell to discharge the capacitance to be charged/discharged from the one terminal of the recovery capacitor through the resonant inductor, thereby recovering electric energy to the recovery capacitor.

6. A charging/discharging apparatus for charging/discharging a capacitance to be charged/discharged by applying a voltage, the apparatus comprising:

a recovery capacitor for recovering electric energy, having one terminal connected to a first power supply through first switch means and another terminal connected to a second power supply through second switch means;

first path forming means, having one terminal connected to the other terminal of the recovery capacitor and another terminal connected to the capacitance to be charged/discharged, for charging the capacitance to be charged/discharged through a resonant inductor when the first switch means is turned on;

second path forming means, having one terminal connected to the one terminal of the recovery capacitor and another terminal connected to the capacitance to be charged/discharged, for discharging the capacitance to be charged/discharged through the resonant inductor when the second switch means is turned on to recover electric energy to the recovery capacitor; and control means for controlling the first and second switch means and the first and second path forming means.

7. The charging/discharging apparatus according to claim 6, wherein the control means activates the first path forming means when the first switch means is turned on to change a potential of the capacitance to be charged/discharged from a first potential to a second potential in a first pulse, turns off the first switch means, and then activates the second path forming means when the second switch means is turned on to change the potential of the capacitance to be charged/discharged from the first potential to the second potential in a second pulse different from the first pulse.

8. The charging/discharging apparatus according to claim 6 or 7, wherein the recovery capacitor has a capacitance larger than the capacitance to be charged/discharged, and is charged to a voltage almost ½ a difference between a potential of the first power supply and a potential of the second power supply in a stable state after charging/discharging is repeated.

9. The charging/discharging apparatus according to any one of claims 6 to 8, wherein one terminal of the capacitance to be charged/discharged is connected to the second power supply through third switch means, and the one terminal of the capacitance to be charged/discharged is connected to the first power supply through fourth switch means, and the control means turns on the third switch means after the first switch is turned on to clamp the capacitance to be charged/discharged to a potential of the second power supply, and turns on the fourth switch means after the second switch is turned on to clamp the capacitance to be charged/discharged to the potential of the second power supply.

10. The charging/discharging apparatus according to any one of claims 6 to 9, wherein the first power supply has a ground potential, each of the first and second path forming means includes rectifying means, each of a polarity of the one terminal of the first path forming means and a polarity of the one terminal of the second path forming means is a first polarity, and each of a polarity of the other terminal of the first path forming means and a polarity of the other terminal of the second path forming means is a second polarity opposing the first polarity.

* * * * *